United States Patent [19]

Widdemer

[11] 4,051,552

[45] Oct. 4, 1977

[54] GOLF GLOVE

[75] Inventor: John D. Widdemer, Gloversville, N.Y.

[73] Assignee: Berkshire Leather Corporation, Gloversville, N.Y.

[21] Appl. No.: 596,292

[22] Filed: July 16, 1975

[51] Int. Cl.[2] ..... A41D 19/00

[52] U.S. Cl. ..... 2/161 A

[58] Field of Search ..... 2/161 A, 161 R, 159, 2/163, 169, 16

[56] References Cited

U.S. PATENT DOCUMENTS

| | | | |
|---|---|---|---|
| 2,343,220 | 2/1944 | Mason | 2/169 X |
| 2,907,047 | 10/1959 | Steinberg | 2/161 A |
| 3,504,379 | 4/1970 | Glick | 2/16 X |
| 3,548,414 | 12/1970 | Fujita | 2/169 |

FOREIGN PATENT DOCUMENTS

| | | | |
|---|---|---|---|
| 877,381 | 9/1942 | France | 2/169 |
| 796,667 | 1/1936 | France | 2/163 |
| 2,308,245 | 2/1973 | Germany | 2/161 A |

*Primary Examiner*—Werner H. Schroeder
*Assistant Examiner*—Peter Nerbun
*Attorney, Agent, or Firm*—Ostrolenk, Faber, Gerb & Soffen

[57] ABSTRACT

A golf glove, including a back portion having four back finger portions; a palm portion having four palm finger portions of coordinately lesser length than the back finger portions; a plurality of curved fourchettes each flat-sewn between aligned edges of the back and palm finger portions along both sides of the middle and ring fingers and along the inner edges of the little and index fingers; and a pair of curved end pieces flat-sewn between opposed outside edges of the little and index fingers from the tip to a position generally midway along the length thereof, for forming each of the four fingers into a normally curved position with respect to the palm area of the glove. The glove includes means to facilitate individual adjustment in tightening the glove to remove slack in a direction transverse to the length of the hand to substantially eliminate bunching in the palm area and contribute to an unimpeded and uniform pressure when the glove is wrapped about a golf club.

8 Claims, 8 Drawing Figures

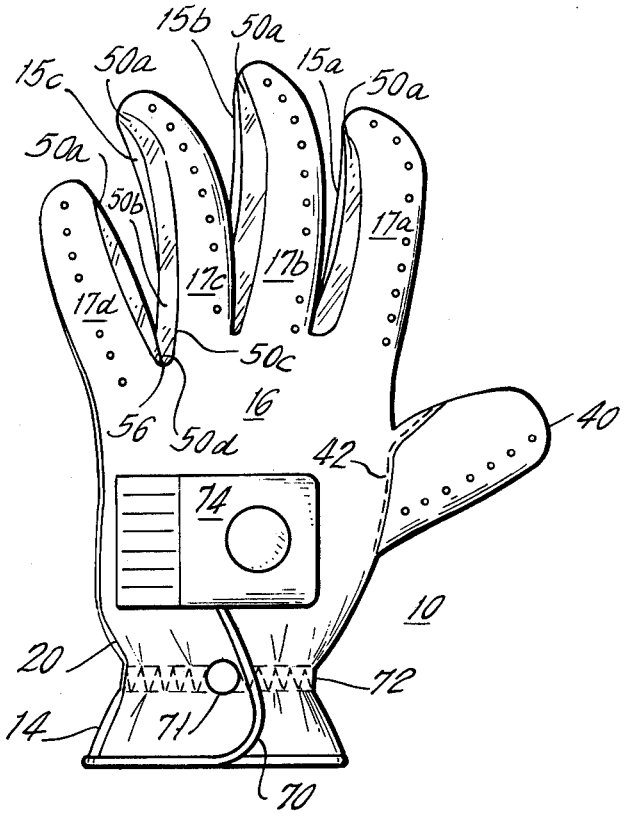
FIG. 1.
FIG. 8.
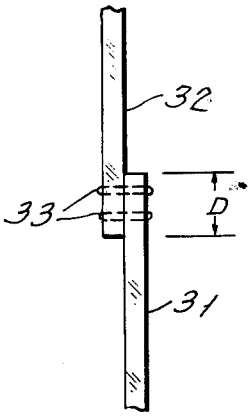
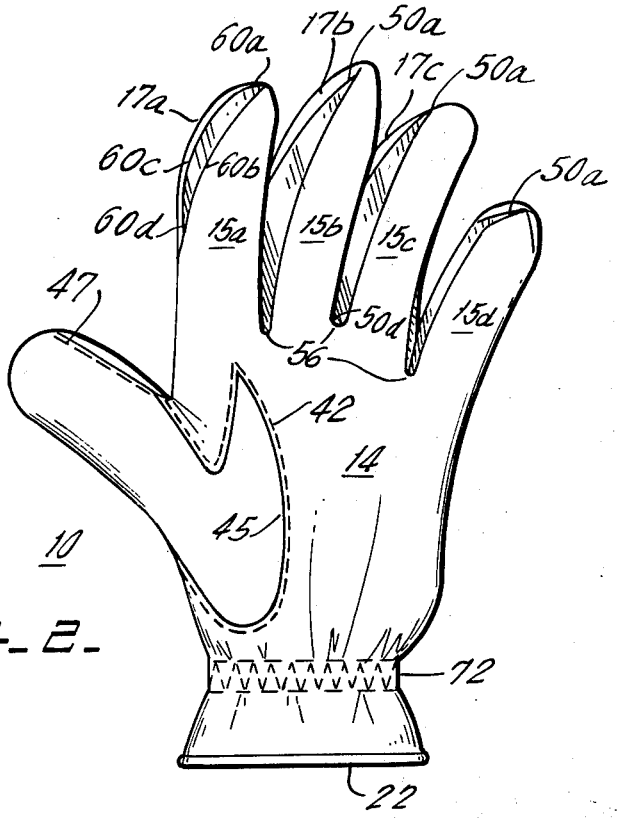
FIG. 2.

FIG. 3.
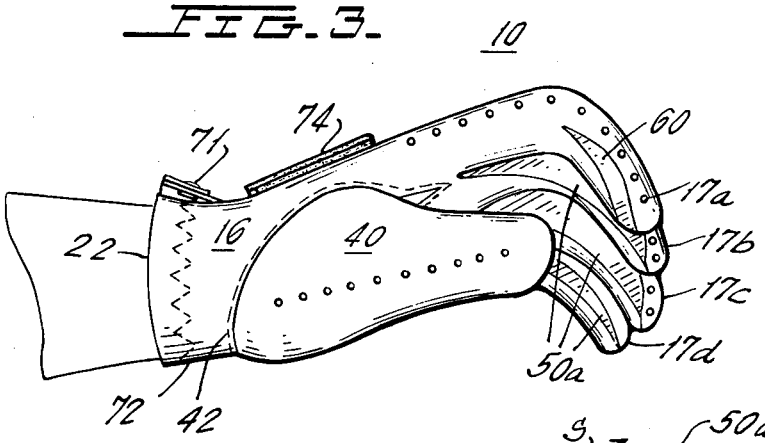
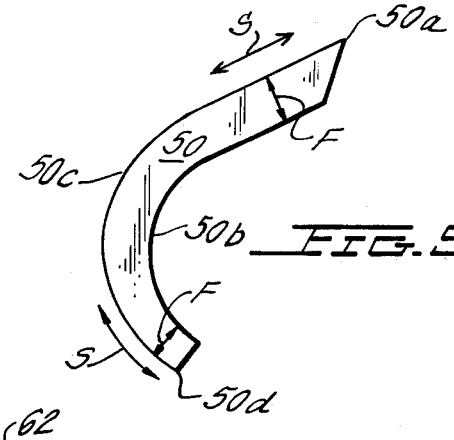
FIG. 5.
FIG. 4.
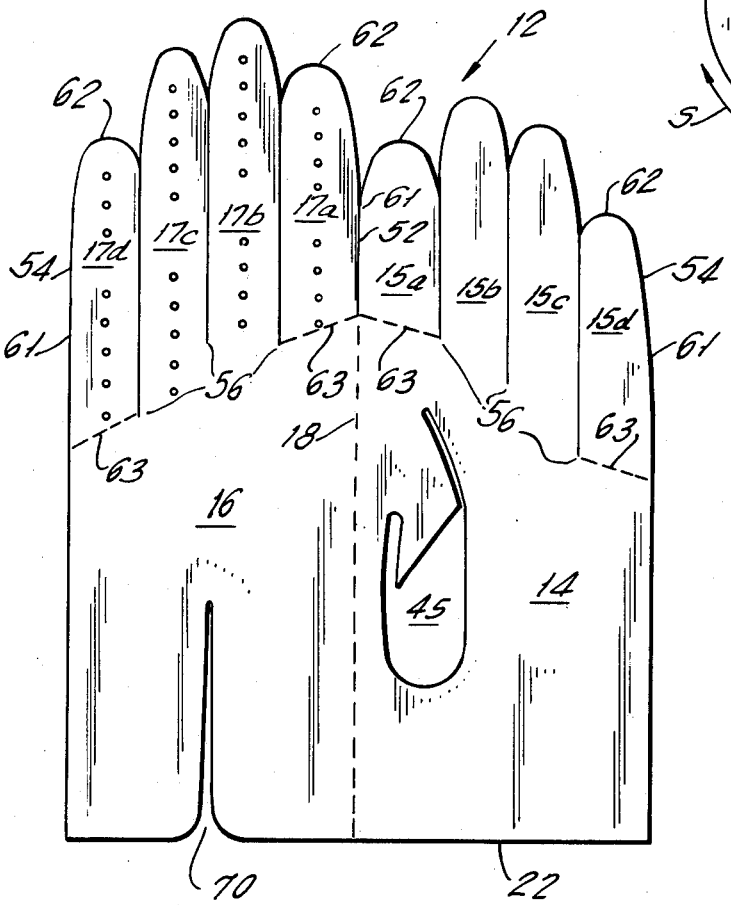
FIG. 7.
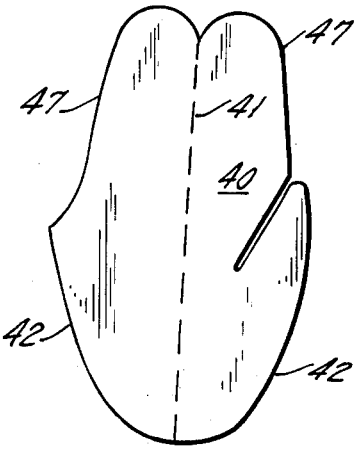
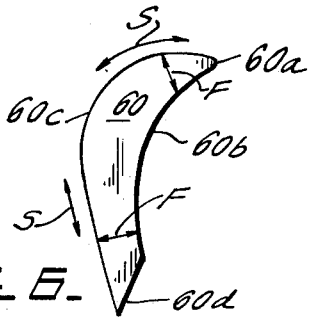
FIG. 6.

GOLF GLOVE

BACKGROUND OF THE INVENTION

The present invention relates to golf gloves and more particularly to a golf glove having normally curved fingers for substantially eliminating bunching of the glove palm area while facilitating an unimpeded grip about a golf club.

It is well known in the prior art to fashion a golf glove wherein the palm and back portions are cut to the same length. Considerable bunching in the palm portion results when the hand is bent to encircle the grip of a golf club, as the back portion of the glove is stretched as a result of the hand being bent while the palm portion of the glove is not. Several attempts have been made in the past to overcome the problem of palm portion bunching. One such arrangement is shown in U.S Pat. No. 3,600,715, issued Aug. 24, 1971, wherein a glove having four straight finger portions includes adjustable fastening means at the back of the glove allowing the glove leather to be stretched sideways across the breadth of the palm and back portions to take up the slack leather in the palm area. The equal back and palm portion finger lengths cause the back portion to stretch in the longitudinal direction while the palm portion loosens and bunches when the hand is bent around the golf club. It is desirable to essentially eliminate palm area bunching while at the same time provide a flexible glove having a minimum amount of palm area thickness to facilitate unimpeded feel of a gripped golf club.

BRIEF SUMMARY OF THE INVENTION

A golf glove eliminating the above described undesirable features and resulting in the palm of the glove remaining smooth and taut when a golf club is gripped, includes, in accordance with the invention, a back portion having four back finger portions and a palm portion having four palm finger portions of coordinately lesser length than the back finger portions; a plurality of curved fourchettes, each fourchette flat-sewn between aligned edges of the back and palm finger portions along the entire length of both sides of the middle and ring fingers and along the inner edges of the little and index fingers; and a pair of curved end pieces each flat-sewn between oppposed outside edges of the little and index fingers from the tip to a position generally midway along the length thereof, for forming each of the four fingers into a curved condition with respect to the palm area of the glove.

In a preferred embodiment, a slit in the back portion furthest from the fingertips, and fastening means adjacent the edges of the slit permit the glove to be donned and removed. Additional fastening means of the "Velcro"type along the edges of the slit facilitate individual adjustment in tightening the glove to remove slack in a direction transverse to the length of the hand, essentially eliminating bunching in the palm area and contributing to an unimpeded and uniform pressure when the glove is wrapped about a golf club.

The curve in the three interior pair of fourchettes as well as of the curved panels in the outer edges of the index and little fingers, is preferably established to be more than half but less than the complete curve desired of the glove when in its final position firmly gripping the golf club.

Accordingly, it is one object of the present invention to provide a golf glove having normally curved fingers to facilitate a more desirable grip upon a golf club by having the palm of the glove remain smooth an taut.

It is another object of the present invention to provide a grip-curved golf glove having an essentially smooth and non-bunching palm area when the glove is fully curved to a final position encircling and firmly contacting a golf club.

These and other objects of the present invention will become apparent upon reading the detailed descriptions and the drawings.

BRIEF SUMMARY OF THE FIGURES

FIGS. 1 and 2 are respective back and palm views of a golf glove in accordance with the principle of the present invention;

FIG. 3 is a perspective view of the golf glove of FIGS. 1 and 2 in the donned condition and illustrating the curvature of the gripped-form fingers;

FIGS. 4, 5, 6 and 7 are respective views of: a slitted blank which is folded to form the glove of FIGS. 1, 2 and 3; a blank for a fourchette, a blank for a curved end piece, and a blank for a thumb portion; and FIG. 8 is a fragment of the glove of FIGS. 1, 2 and 3 illustrating the formation of a flat seam between adjacent blank portions.

DETAILED DESCRIPTION OF THE INVENTION

A major portion of glove 10 is formed from a blank 12 (FIG. 4) of conventional glove material, such as leather. Blank 12 comprises a palm portion 14, which covers the palm of the hand and from which extend an index finger portion 15*a*, a middle finger portion 15*b*, a ring finger portion 15*c* and a little finger portion 15*d*. Panel 12 further comprises a rear portion 16 which covers the rear of the hand and from which index finger portions 17*a*, middle finger portion 17*b*, ringer finger portion 17*c* and little finger portion 17*d* extend, each having a longer length from its tip to its juncture with an adjacent finger portion than does each of the coordinate finger portion, 15*a*, 15*b*, 15*c*, 15*d*, respectively, of the palm portion 14.

Blank 12 is folded over along line 8 and is fastened together along seam 20 (FIG. 1) from wrist periphery 22 to approximately midway along the length of the adjacent little finger portions 15*d* and 17*d*.

Seam 20, and all other seams to be hereinafter described, are known flat seams (FIG. 8) formed by overlapping a first glove portion 31 with an adjacent glove portion 32 for a short distance D and by securing the abutting surfaces thereof with fastening means 33, such as at least one line of fixed threads.

A thumb covering portion 40 (FIG. 7) is folded along line 41 and is attached along seam 42 to the periphery of thumb opening 45 in panel 12. A second flat seam 47 is formed between the overlapped remaining edges of thumb covering portion 40 thereby completing coverage of the thumb of the golfer.

To achieve the desired grip-curved fingers, a plurality of curved fourchettes 50 (FIG. 5) are utilized. Each fourchette 50 is flat-sewn between shorter palm finger portions 15*a*–15*d* and longer back finger portions 17*a*–17*d* except for outer index finger edge portion 52 and outer little finger portion 54 (FIG. 4). Each fourchette 50 includes a pointed end 50*a* flat-sewn at the tip of each finger portion. Opposite fourchette edges 50*b* and 50*c* are flat-sewn to edges of respective palm and back hand finger portions 15 and 17. A remaining end 50*d* each fourchette 50 is similarly flat-sewn to the remaining end of the adjacent fourchette at the junction 56 between adjacent finger portions to complete the enclosure of both sides of the middle and ring fingers and of the inner sides of the index and little fingers.

Each of a pair of curved end pieces 60 (FIG. 6) is flat-sewn between adjacent palm and back index finger portions 15*a* and 17*a*, respectively, and adjacent palm and rear little finger portions 15*d* and 17*d*, respectively, to complete the glove enclosure. Each curved end piece 60 includes a curved end 60*a* flat-sewn at the tip of each index and little finger. Opposed curved sides 60*b* and 60*c* are flat-sewn to edges of respective palm and back portions 15*a* or 15*d* and 17*a* or 17*d*, along the lengths thereof. The remaining end 60*d* is flat-sewn to the palm and back portions 14 and 16 at a point 61 coincident with the second knuckle joint of the wearer, which point is generally one-third of the length from the base, indicated by dotted lines 63, to the tips 62 of each index and little finger.

The curve for each of the six fourchettes 50 and two curved pieces 60 is predeterminately selected such that the fingers of the donned glove (FIG. 3) are normally curved upwardly and inwardly towards palm area 14 with an arc approximately one half the total arc required of the glove when gripping the handle of a golf club. The thumb covering portion 40 is not curved, as a proper golf grip requires the thumb to be straightly extended along the shaft of the golf club.

I have found that the desired grip-curved finger shape is most easily obtained by stretching the leather in the direction of arrow S (Figs. 5 and 6) to the greatest extent possible prior to cutting, to reduce the amount of stretch along the length of each finger and hence the possibility for straightening each finger. Each fourchette 50 and end piece 60 will flex in the directions of arrows F as the fingers are inserted and as the hand is folded to its position fully gripping the golf club handle.

Known donning and removal means, such as a slitted opening 70 wth a snap fastener 71 and the like, are provided in rear hand portion 16. In a preferred embodiment, an elastic strip 72 passes around the glove near wrist edge 22 to tightly secure the wrist of the glove on the wrist of the wearer when slitted opening 70 is closed by snap 71. Additional fastening means 74, preferably comprised of the material known as "Velcro", is provided along opposed edges of opening slit 70 to gather any surplus rear portion material and maximize the tautness and smoothness of palm portion 14 of the glove.

It will now be apparent to those knowledgable in the art that the grip-curved fingers of the golf glove just described, drastically reduces the amount of glove material in palm area 14, thereby substantially eliminating glove bunching so that the palm is smooth and taut when the glove is curved to grip the handle of the golf club. Additionally, a generally unimpeded feel of the golf club handle is obtained through the use of flat seams and by the use of curved pieces only along the upper two-thirds of the outside edges of the index and little fingers, which are generally those finger portions most intimately in contact with the golf club handle, thereby reducing to the fullest extent possible the thickness of glove material between the golf club handle and the hand of the wearer.

The present invention has been described with reference to a preferred embodiment thereof many variations and modifications will now become apparent to those skilled in the art. It is preferred, therefore, that the present invention be limited not by the specific disclosure herein, but only by the appended claims.

What is claimed is:

1. A golf comprising:

a rear portion having a wrist edge and having a plurality of rear portion finger portions extending from the edge opposite said rear portion wrist edge to a respective tip; said rear portion finger portions including, in sequence, an index finger portion, a middle finger portion, a ring finger portion and a little finger portion; each said rear portion finger portion being joined at the base thereof to the adjacent said rear portion finger portion at a junction;

a palm portion having a wrist edge and a thumb opening spaced from said palm portion wrist edge and being defined by a periphery; said palm portion having a corresponding plurality of finger portions extending from the edge opposite said palm portion wrist edge to a respective tip; said palm portion finger portions including, in sequence away from said thumb opening, and index finger portion, a middle finger portion, a ring finger portion and a little finger portion; each said rear portion palm portion being joined at the base thereof to the adjacent said rear portion palm portion at a junction each said rear portion finger portion and the respective said palm portion finger portion being so positioned on their respective said rear and palm portions as to generally be overlaid;

each of said plurality of palm portion finger portions having a proportionally shorter length from its said tip to its said junction than the length of the corresponding one of said plurality of rear portion finger portions;

a thumb enclosing portion fastened along said periphery of said thumb opening and shaped to form a generally straight enclosure for the thumb of the wearer;

a plurality of fourchettes each extending from a said tip of a said finger portion to a said junction; each said fourchette having first and second curved opposite contoured edges which are both curved generally in the same direction; each said fourchette being fastened along one of its said first and second curved edges to one edge of a said palm portion finger portion and being fastened along the opposite said curved edge to the opposed edge of the corresponding said rear portion finger portion each said fourchette extending from the said tip of its said finger portions to said junctions thereof; each aid forchette being prestretched along said contoured edge fastened to its corresponding rear finger portion to reduce the amount of stretch along the length of each finger as the hand is folded to its position fully gripping a golf club handle;

a first curved end piece having a pair of opposite contoured edges; one of said first end piece opposite edges being fastened to the said palm portion index finger portion nearest to said thumb enclosure and the other of said first end piece opposite edges being fastened to the corresponding edge of said rear portion index finger portion;

a second curved end piece having a pair of opposite contoured edges, one of said second end piece opposite edges being fastened to the said palm portion little finger portion furthest from said thumb enclosure and the other of said second end piece opposite edges being fastened to the corresponding edge of said rear portion little finger portion;

said palm and rear portions being fastened to each other along a remaining glove edge, said palm and rear portion wrist edges remaining unfastened;

each said fourchette and said first and second end pieces having their said curved edges predeterminately established and shaped to curl said finger portions upwardly above said palm portion and inwardly along an arc extendable generally towards said palm portion wrist edge and to generally conform said finger portions to the shapes of the wearer's fingers, thereby to avoid bunching of the glove fabric on the fingers and around the finger joints.

2. A golf glove as set forth in claim 1, further comprising a wrist portion which covers the wearer's wrist; and means provided in said wrist portion for permitting said glove to be donned and removed.

3. A golf glove as set forth in claim 2, wherein said donning and removing means comprises an opening in said rear portion inward from said wrist edge to permit widening of said wrist portion when said glove is donned and removed; and fastening means extended between opposed edges of said opening for closing said opening after said glove is donned and for opening said opening before said glove is removed.

4. A golf glove as set forth in claim 3, wherein said golf glove further comprises elastic means completely passing around said wrist portion near said wrist edge for holding said glove tightly on the wrist after said fastening means is secured.

5. A golf glove as set forth in claim 1, further including means for tautening said palm portion once said glove has been donned.

6. A golf glove as set forth in claim 1, wherein a single blank of glove material forms said palm and rear portions, said blank being folded about an imaginary fold line extended between said wrist edge and the edges of said palm portion index finger portion and said rear portion index finger portion nearest to said thumb enclosure, a pair of opposed blank free ends being folded adjacent each other to form said remaining glove edge.

7. A golf glove as set forth in claim 1, wherein each said fourchette and said first and second end pieces are stretched only in the direction along the curve thereof prior to fastening to said palm and rear finger portions to minimize the amount of flexure along the length of each finger portion.

8. A golf glove as set forth in claim 1, wherein each of said seams is a flat-sewn seam to minimize the thickness of said palm portion of the finished golf glove.

* * * * *